US010814374B2

(12) United States Patent
Park et al.

(10) Patent No.: US 10,814,374 B2
(45) Date of Patent: Oct. 27, 2020

(54) COOLING APPARATUS FOR A HOT STAMPING DIE

(71) Applicants: MS AUTOTECH CO., LTD., Gyeongju-si (KR); KOREA UNIVERSITY RESEARCH AND BUSINESS FOUNDATION, Seoul (KR)

(72) Inventors: Sung Yong Park, Suwon-si (KR); Won IK Eom, Uiwang-si (KR); Sung Ho Yun, Seoul (KR); Jun Ho Kwon, Seoul (KR); Yong Chan Kim, Seoul (KR)

(73) Assignees: MS AUTOTECH CO., LTD., Gyeongju-si (KR); KOREA UNIVERSITY RESEARCH AND BUSINESS FOUNDATION, Seoul (KR); MYUNGSHIN INDUSTRY CO., LTD., Gyeongju-si (KR)

( * ) Notice: Subject to any disclaimer, the term of this patent is extended or adjusted under 35 U.S.C. 154(b) by 302 days.

(21) Appl. No.: 15/949,604

(22) Filed: Apr. 10, 2018

(65) Prior Publication Data

US 2018/0290197 A1 Oct. 11, 2018

(30) Foreign Application Priority Data

Apr. 11, 2017 (KR) ..... 10-2017-0046830

(51) Int. Cl.
*B21D 37/16* (2006.01)
*B21D 22/02* (2006.01)

(52) U.S. Cl.
CPC ..... *B21D 37/16* (2013.01); *B21D 22/022* (2013.01); *F25B 2600/21* (2013.01); *F25B 2600/2515* (2013.01); *F25B 2700/21174* (2013.01); *F25B 2700/21175* (2013.01)

(58) Field of Classification Search
CPC ..... B21D 37/16; C21D 1/673
See application file for complete search history.

(56) References Cited

U.S. PATENT DOCUMENTS

2009/0242086 A1* 10/2009 Thomas ..... C21D 1/673 148/654
2009/0320547 A1* 12/2009 Horton ..... B21J 13/02 72/342.3
2015/0246383 A1* 9/2015 Young ..... B21D 37/16 72/342.3

FOREIGN PATENT DOCUMENTS

JP 1996200915 A 8/1996
JP 2003262412 A 9/2003
JP 2014117709 A 6/2014
KR 20110092649 A 8/2011

* cited by examiner

*Primary Examiner* — Scott R Kastler
(74) *Attorney, Agent, or Firm* — STIP Law Group, LLC

(57) ABSTRACT

A cooling apparatus for a hot stamping die is configured such that a refrigerant in a two-phase coexisting state of a liquid phase and a gas phase is supplied to a cooling channel formed in the hot stamping die to cool the hot stamping die using latent heat of the refrigerant. The refrigerant maintains a constant temperature in the cooling channel of the hot stamping die, which ensures uniform cooling of the hot stamping die.

9 Claims, 2 Drawing Sheets

COOLING APPARATUS FOR A HOT STAMPING DIE

CROSS-REFERENCE TO RELATED APPLICATION

This application claims the benefit of Korean Patent Application No. 10-2017-0046830, filed on Apr. 11, 2017, the disclosure of which is incorporated herein in its entirety by reference.

BACKGROUND OF THE INVENTION

The present invention relates to a cooling apparatus for a hot stamping die, and more particularly, to a cooling apparatus for a hot stamping die, capable of more uniformly and effectively cooling the hot stamping die.

Generally, the proportion of vehicle body parts made of high strength steels increases to meet the environmental regulations and achieve vehicle weight reduction.

Such high strength steels have low formability at room temperature and leads to dimensional defects due to spring back which constitute problems in forming process of high-strength steels.

Recently, the number of hot stamped parts used in vehicles for the weight reduction is growing.

In hot stamping process, a steel blank or sheet is heated to a temperature above Ac3, for example, about 850° C. to 950° C. The heated steel blank is transferred to a forming die within several seconds and is cooled while press-forming. A cooling channel is provided in the forming die for allowing a cooling water to pass through the forming die.

The hot stamping process provides excellent formability and dimensional accuracy since steel sheets are formed at high temperature. Also, it is possible to obtain a vehicle part having the tensile strength of about 1,500 MPa or more by the hot stamping process.

The cooling water is supplied to the cooling channel of the die for hot stamping. Since the cooling water takes heat from the die while flowing along the cooling channel, the temperature of the cooling water is gradually increased. The temperature of the cooling water is lowest at an inlet of the cooling channel where the cooling water is supplied to the die and is highest at an outlet of the cooling channel where the cooling water is discharged from the die. To put another way, cooling efficiency is highest at the inlet portion and is gradually reduced toward the outlet portion. This phenomenon causes non-uniform cooling of the hot stamping die and deteriorates the quality of the hot stamped body parts.

SUMMARY

The present invention has been made in consideration of the aforementioned problem, and an object of the present invention is to provide a cooling apparatus for a hot stamping die, capable of more uniformly and efficiently cooling the hot stamping die.

In order to accomplish the above object, a cooling apparatus for a hot stamping die according to the present invention is configured to cool the hot stamping die with a refrigerant flowing along a cooling channel formed in the hot stamping die. The refrigerant while flowing along the cooling channel may be in a condition that allows its liquid and gas phases to coexist and cool the hot stamping die using the latent heat of vaporization. Commonly, a hot stamping die includes an upper die and a lower die. A cooling apparatus according to the present invention may be to cool the upper die and/or the lower die.

The refrigerant flowing into or being supplied to the cooling channel of the hot stamping die may not be in the liquid-gas phase coexistence condition or its saturated liquid state. The temperature of the refrigerant supplied to the cooling channel may be slightly lower than the evaporating temperature or boiling point of the refrigerant, and desirably, be in the range of about 97% to about 99.5% of the evaporating temperature thereof. Such temperature condition allows the enthalpy of vaporization of the refrigerant, i.e., the latent heat of the refrigerant to be sufficiently used for cooling the hot stamping die even when the difference is small between the temperature of the refrigerant supplied to the hot stamping die and the temperature of the refrigerant discharged from the hot stamping die.

According to the present invention, the refrigerant may be in a two-phase coexistence region while passing through the cooling channel of the hot stamping die. If there is no environmental problem, the higher the enthalpy of vaporization of the refrigerant is more desirable.

According to the present invention, a compressor may not be necessary to compress the refrigerant discharged from the hot stamping die. The temperature change of the refrigerant circulating components of the cooling apparatus may be very small. The temperature of the refrigerant being discharged from the hot stamping die may be near the vaporization temperature of the refrigerant. For this, a flow rate of the refrigerant supplied to the hot stamping die may be controlled.

According to an embodiment, the cooling apparatus for the hot stamping die includes: a reservoir storing a refrigerant; a refrigerant supply line connecting the reservoir and an inlet of the cooling channel; and a refrigerant discharge line connecting the reservoir and an outlet of the cooling channel.

In addition, according to an embodiment, the cooling apparatus for the hot stamping die may include a flow regulator for regulating a flow rate of the refrigerant supplied to the cooling channel of the hot stamping die, and a heater provided in the refrigerant supply line and heating the refrigerant. A pump may be provided in the refrigerant supply line and/or the refrigerant discharge line to circulate the refrigerant from the reservoir to the cooling channel of the hot stamping die. The refrigerant stored in the reservoir may be liquid.

According to the cooling apparatus according to the present invention, since the hot stamping die is cooled using latent heat of a refrigerant, the temperature of the refrigerant may be constantly maintained in the cooling channel, which ensures uniform cooling of the hot stamping die.

According to the present invention, efficient cooling of the hot stamping die can be achieved by using a refrigerant having a high enthalpy of vaporization.

BRIEF DESCRIPTION OF THE DRAWINGS

Embodiments of the present invention will be more clearly understood from the following detailed description taken in conjunction with the accompanying drawings in which.

DETAILED DESCRIPTION OF THE EMBODIMENTS

Figure 1:
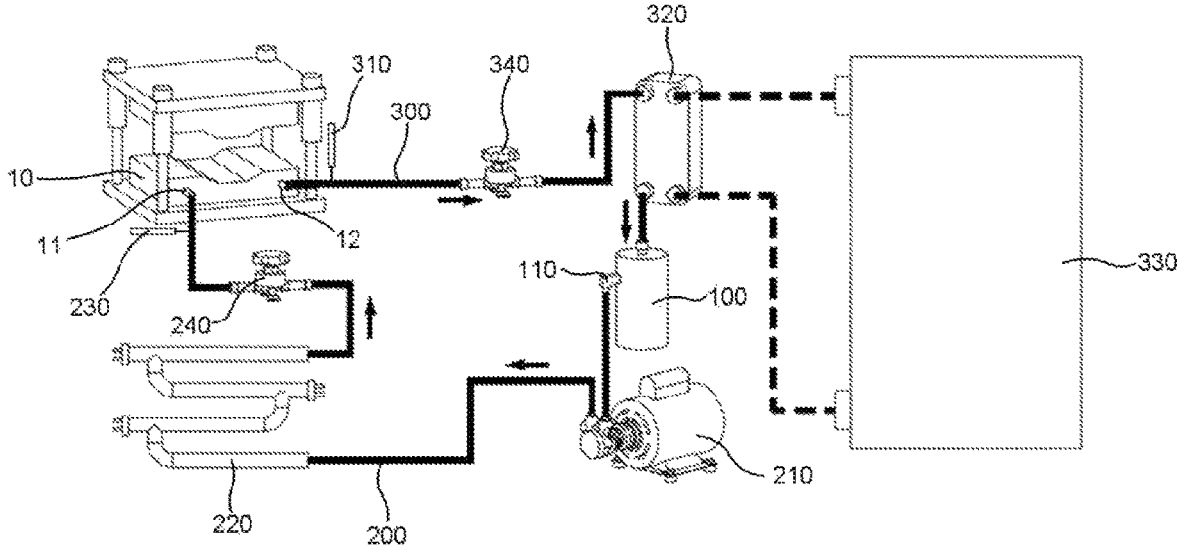
FIG. 1 is a schematic diagram illustrating a cooling apparatus for a hot stamping die, according to an embodiment of the present invention.

In order to help understand features of the present invention, a cooling apparatus for a hot stamping die according to embodiments of the preset invention will be described in more detail.

To help understanding of the embodiments to be described, it is to be noted that in giving reference numerals to elements of each drawing, like reference numerals refer to like elements even though like elements are shown in different drawings.

Further, in describing the present invention, well-known functions or constructions will not be described in detail since they may unnecessarily obscure the understanding of the present invention.

Hereinafter, the present invention will be described in detail through embodiments with reference to the accompanying drawings.

Figure 2:
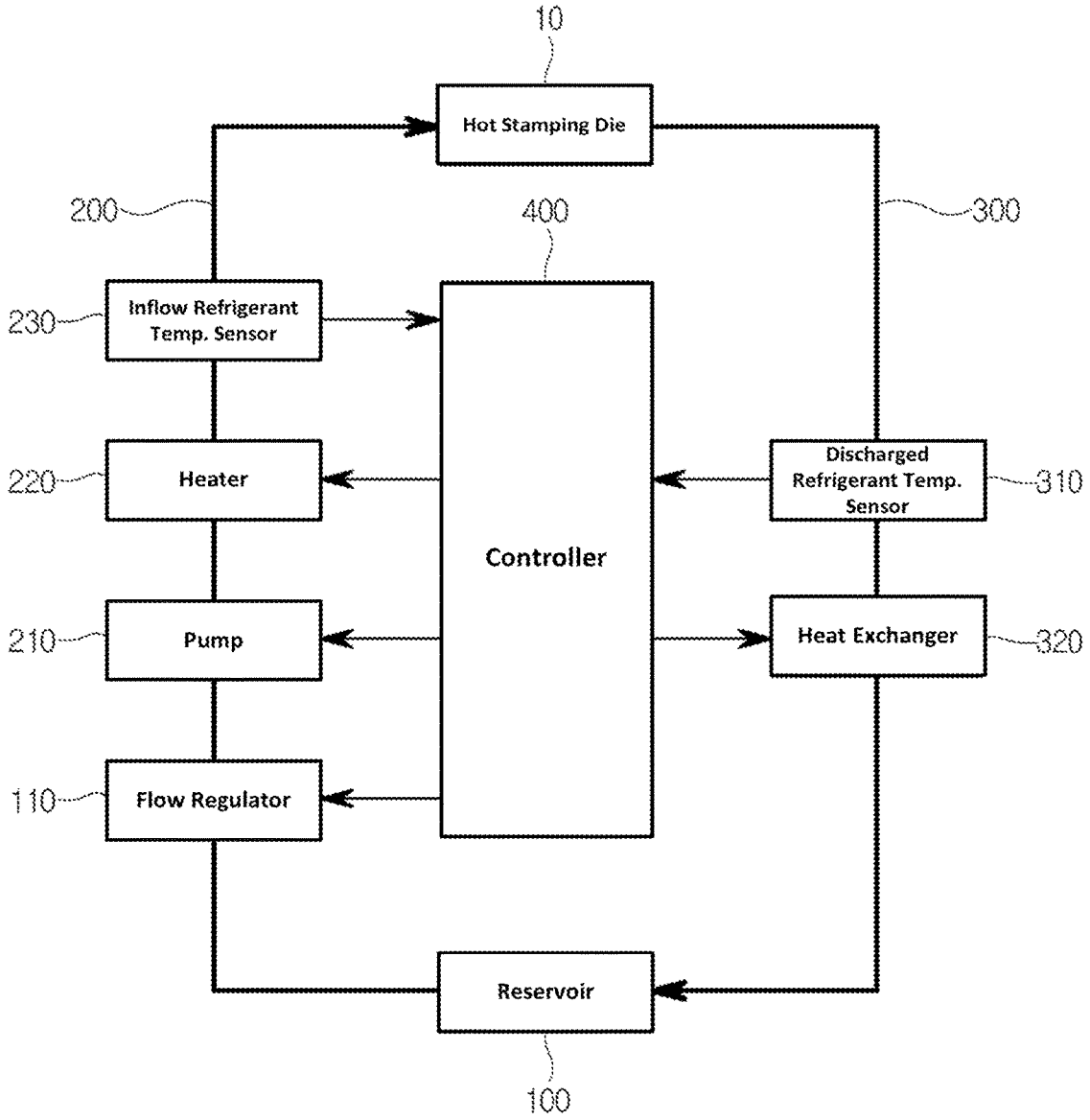
FIG. 2 is a schematic block diagram illustrating the cooling apparatus for the hot stamping die, according to the embodiment of the present invention.

FIGS. 1 and 2 are respectively a schematic diagram and a schematic block diagram illustrating a cooling apparatus for a hot stamping die 10, according to an embodiment of the present invention.

Referring to FIGS. 1 and 2, the cooling apparatus according to the embodiment of the present invention is provided to cool the hot stamping die 10 for forming a heated object, for example, a metal sheet or a blank. The cooling apparatus cools the hot stamping die 10, and the cooled hot stamping die 10 cools the heated object. In an example, the temperature of the object is about 900° C. when the object is placed on the hot stamping die 10. The temperature of the object is about 200° C. when the object is taken out from the hot stamping die 10 after press-forming. The object is cooled from about 900° C. to about 200° C. during a hot stamping process, and heat corresponding to the temperature difference, i.e., 700° C. is transferred to the hot stamping die 10.

Water is a common cooling medium for hot stamping die 10. However, the cooling apparatus for the hot stamping die 10 according to the embodiment cools the hot stamping die 10 using a chemical refrigerant rather than water.

The refrigerant is supplied to a cooling channel (not shown) formed in the hot stamping die 10 after being heated to or just below the evaporation temperature of the refrigerant. In some cases, the refrigerant may be heated to a state in which two phases (liquid, gas) can coexist and supplied to the cooling channel. The hot stamping die 10 is cooled using latent heat of the refrigerant. The refrigerant may be selected from materials of which liquid and gas phases can coexist under the temperature and pressure conditions of the cooling channel while the hot stamping die 10 is operated. For example, the refrigerant may be selected from various known refrigerants such as R-134a, R-245fa, R-1234yf, and R-1233zd, etc., or from refrigerants to be developed.

The cooling apparatus according to the embodiment is based on the fact that using the latent enthalpy of a refrigerant is superior than using the sensible enthalpy of water for the cooling performance or capacity of the cooling apparatus. If the temperature at the inlet 11 of the cooling channel and the flow rate supplied to the cooling channel are same, the performance of the refrigerant using the latent heat is 3 to 5 times better than water using sensible heat for cooling.

If water is heated from about 40° C. to about 50° C. while passing through the cooling channel of the hot stamping die 10, the sensible enthalpy that the water can receive from the hot stamping die 10 is about 42 kJ/kg. In comparison, the vaporization enthalpies of the refrigerants R-134a, R-245fa, and R-1234yf are about 163 kJ/kg, about 181 kJ/kg, and about 132 kJ/kg at about 40° C., respectively. The flow rates of the refrigerants used for cooling the hot stamping die 10 and the energy consumption of the entire cooling system can be reduced, since the vaporization enthalpies of the refrigerants is three times greater than the sensible enthalpy of water.

The cooling apparatus for the hot stamping die 10 includes a reservoir 100 for storing a refrigerant in a liquid state, a refrigerant supply line 200 connecting the reservoir 100 and an inlet 11 of the cooling channel inlet of the hot stamping die 10, a flow regulator 110 for regulating the flow rate of the refrigerant supplied to the refrigerant supply line 200, a pump 210 disposed in the refrigerant supply line 200 to circulate the refrigerant from the reservoir 100 to the hot stamping die 10, a heater 220 disposed in the refrigerant supply line 200 between the pump 210 and the hot stamping die 10 to heat the refrigerant, and a refrigerant discharge line 300 connecting a outlet 12 of the cooling channel and the reservoir 100. The flow regulator 110 is provided in the reservoir 100 or the refrigerant supply line 200.

The cooling apparatus further includes an inflow refrigerant temperature sensor 230 provided in the refrigerant supply line 200 to measure a temperature of the refrigerant inflowing into the cooling channel of the hot stamping die 10, a discharged refrigerant temperature sensor 310 disposed in the refrigerant discharge line 300 to measure a temperature of the refrigerant discharged from the cooling channel of the hot stamping die 10, and a controller 400 receiving temperature data from the inflow refrigerant temperature sensor 230 and the discharged refrigerant temperature sensor 310 and controlling the heater 220 and the flow regulator 110 in response to the measured temperatures.

The flow regulator 110 controls a flow rate of the refrigerant from the reservoir 100 to the refrigerant supply line 200. The pump 210 is operated to supply the refrigerant toward the hot stamping die 10. Before the refrigerant is supplied to the cooling channel, the refrigerant is heated by the heater 220. The refrigerant may be heated to an evaporating temperature, or to or just blow a temperature where the refrigerant can be in a state of the two-phase coexistence state of a liquid phase and a gas phase.

The cooling channel is a region where the refrigerant evaporates. In the cooling channel, the refrigerant in a liquid state is transformed to a gas state. Although the refrigerant passing through the cooling channel receives heat from the hot stamping die 10, the temperature of the refrigerant may not increase. The refrigerant cools the hot stamping die 10 using the latent heat thereof. A liquid refrigerant heated to an evaporating temperature thereof may start to evaporate and maintain almost a constant temperature until the whole liquid refrigerant is transformed to its gas phase, although the enthalpy of the refrigerant may increase.

Since the refrigerant passing through the cooling channel of the hot stamping die 10 maintains almost a constant temperature, the hot stamping die 10 can be uniformly cooled.

The refrigerant passed through the cooling channel is discharged to the reservoir 100 through the refrigerant discharge line 300. A heat exchanger 320 may be provided in the refrigerant discharge line 300 to condense the refrigerant completely to liquid. The refrigerant may be stored in a liquid state in the reservoir 100.

The heat exchanger 320 is disposed in the refrigerant discharge line 300 and exchanges heat with the refrigerant such that the refrigerant discharged to the reservoir 100 becomes a liquid. To this end, a coolant to exchange heat with the refrigerant may be supplied to the heat exchanger 320 from a chiller 330.

The controller 400 controls the heater 200, the flow regulator 110, and the heat exchanger 320 to cool the hot stamping die 10 using the latent heat of the refrigerant.

The controller 400 receives temperature data of the refrigerant flowing into the cooling channel of the hot stamping die 10 from the inflow refrigerant temperature sensor 230 and may control the heater 220 such that a temperature of the refrigerant flowing into the cooling channel of the hot stamping die 10 is in the range of about 97% to about 99.5% of an evaporating temperature of the refrigerant. That is, the refrigerant being supplied to the cooling channel may be heated just below the evaporating temperature. Although not shown in drawings, in order for more precise temperature control, a temperature sensor may be further provided in the heater 220 to measure a temperature of the refrigerant flowing into the heater 220.

In the case that the refrigerant is heated to or just below the evaporating temperature, the enthalpy of the refrigerant can increase without causing the temperature of the refrigerant to change while the refrigerant flows along the cooling channel of the hot stamping die 10. When the heater 220 overheats the refrigerant, the cooling capacity or the usable latent heat of evaporation of the refrigerant is decreased.

When the refrigerant is supplied to the hot stamping die 10 in a state of being heated higher than the evaporating temperature, the refrigerant can be discharged from the hot stamping die 10 in an overheated gas state due to the heat energy received from the hot stamping die 10. If the refrigerant is discharged at the overheated gas state from the hot stamping die 10, energy consumption increases to cool the refrigerant to a liquid state. In addition, since the heater 220 also consumes energy to heat the refrigerant, excessive heating by the heater 220 is not advantageous.

When the refrigerant is heated to or more than the vaporization temperature of the refrigerant, it is difficult to specify the amount of enthalpy that is usable to cool the hot stamping die 10. By supplying the refrigerant heated just below the evaporating temperature to the hot stamping die 10 and controlling the cooling apparatus so that the temperature of the refrigerant discharged from the hot stamping die 10 becomes approximately to the evaporating temperature of the refrigerant, a waste of energy can be reduced and the hot stamping die 10 can be efficiently cooled.

When a temperature of the refrigerant discharged from the cooling channel of the hot stamping die 10 is higher than the evaporating temperature of the refrigerant, the controller 400 controls the flow regulator 110 to increase the flow rate of the refrigerant. The fact that the refrigerant is discharged from the cooling channel in an overheated gas state in which the temperature thereof is higher than the evaporating temperature thereof, may mean that the refrigerant received more heat energy than the enthalpy of vaporization of the refrigerant from the hot stamping die 10. Accordingly, the controller 400 controls the flow regulator 110 to increase the flow rate of the refrigerant such that the refrigerant being discharged from the hot stamping die 10 maintains the evaporating temperature thereof.

The flow rate of the refrigerant may be equal to or greater than a minimum flow rate set to correspond to a size of the object to be press-formed by the hot stamping die 10, a target temperature of the object after the press-forming, and a process time. The minimum flow rate of the refrigerant is a minimum flow rate of the refrigerant, which needs to be supplied to the hot stamping die 10 so as to cool the object to the target temperature. The minimum flow rate may be obtained by calculating a flow rate of the refrigerant during the process time to absorb heat energy which is transferred to the hot stamping die 10 from the object during one stroke of stamping. The process time may include the time required for forming and replacing the object.

The minimum flow rate may be set through the following equation:

$$\dot{m}_{min} = \frac{A \cdot D \cdot \rho \cdot C_p \cdot \Delta T}{(t_1 + t_2)} \cdot \frac{1}{h_{fg}}$$

In the equation, $\dot{m}_{min}$ is a minimum flow rate [kg/s], A is an area [$m^2$] of the object, D is a thickness [m] of the object, ρ is density of the object, Cp is specific heat [kJ/kg° C.] of the object, ΔT is a difference between an initial temperature and a final temperature of the object, $t_1$ is an amount of time required for forming the object, $t_2$ is an amount of time required for replacing the object, $h_{fg}$ is latent enthalpy [kJ/kg] of the refrigerant.

If the refrigerant used or the size of the object is changed, the controller 400 re-calculates the minimum flow rate using the equation and controls the flow regulator 110 to supply the refrigerant at the calculated minimum flow rate or more.

When the temperature of the refrigerant flowing into the heat exchanger 320 is equal to the evaporating temperature of the refrigerant, the controller 400 may control the heat exchanger 320 to operate. When the temperature of the refrigerant flowing into the heat exchanger 320 is lower than the evaporating temperature of the refrigerant, the controller 400 may control the heat exchanger 320 not to operate. Although not shown in drawings, a temperature sensor may be further provided in the heat exchanger 320 to measure a temperature of the refrigerant.

The temperature of the refrigerant discharged from the hot stamping may be cooled while passing through the refrigerant discharge line 300. When the temperature of the refrigerant flowing into the heat exchanger 320 is lower than the evaporating temperature thereof, the refrigerant may be liquid. In this case, to minimize energy consumption, the heat exchanger 320 may not be operated.

Valves 240 and 340 may be respectively provided in the refrigerant supply line 200 and the refrigerant discharge line 300 to open/close its passage. The valves 240 and 340 may make it convenient to replace the hot stamping die 10. When the hot stamping die 10 is replaced, the valves 240 and 340 are operated to close the refrigerant supply line 200 and the refrigerant discharge line 300, and then, the refrigerant supply line 200 and the refrigerant discharge line 300 are detached from the hot stamping die 10. Only the refrigerant remaining in the refrigerant supply line 200 between the hot stamping die 10 and the valve 240 and remaining in the refrigerant discharge line 300 between the hot stamping die 10 and the valve 340 is discharged, which makes it possible to minimize the waste of the refrigerant while replacing or repairing the hot stamping die 10.

The cooling apparatus according the embodiment can be used to cool the hot stamping die 10 alone or together with a cooling apparatus using water. As an example, a water cooling apparatus is used to cool the whole die 10 and a cooling apparatus according to the embodiment is used to cool a local portion of the die 10 where additional cooling is required. In such a case, the heat exchanger 320 according to the embodiment may be connected to the water cooling apparatus. For example, a water supplying unit of the water cooling apparatus may be used for the chiller 330 according to the embodiment.

While the invention has been shown and described with reference to predetermined exemplary embodiments thereof, it will be understood by those skilled in the art that various changes in form and details may be made therein without departing from the scope of the invention as defined by the appended claims.

What is claimed is:

1. A cooling apparatus for a hot stamping die having a cooling channel provided therein, the cooling apparatus comprising:

a reservoir storing a refrigerant;

a refrigerant supply line connecting the reservoir and an inlet of the cooling channel;

a refrigerant discharge line connecting an outlet of the cooling channel and the reservoir;

a flow regulator provided in the reservoir or the refrigerant supply line to regulate a flow rate of the refrigerant supplied to the inlet of the cooling channel; and a heater provided in the refrigerant supply line to heat the refrigerant, wherein the refrigerant flowing along the cooling channel is in a two-phase coexisting state of a liquid phase and a gas phase, and cools the hot stamping die using latent heat thereof.

2. The cooling apparatus of claim 1, further comprising:

an inflow refrigerant temperature sensor provided in the refrigerant supply line or at the inlet of the cooling channel to measure a temperature of the refrigerant supplied to the hot stamping die; and a discharged refrigerant temperature sensor provided in the refrigerant discharge line or at the outlet of the cooling channel to measure a temperature of the refrigerant discharged from the hot stamping die.

3. The cooling apparatus of claim 2, further comprising a controller receiving temperature data from the inflow refrigerant temperature sensor and the discharged refrigerant temperature sensor and controlling the heater and the flow regulator in response to the received temperature data.

4. The cooling apparatus of claim 3, wherein the controller is configured to controls the heater such that a temperature of the refrigerant flowing into the cooling channel of the hot stamping die is in the range of 97% to 99.5% of an evaporating temperature of the refrigerant.

5. The cooling apparatus of claim 4, wherein the controller is configured to controls the flow regulator to increase the flow rate of the refrigerant supplied to the cooling channel when the temperature of the refrigerant discharged from the cooling channel of the hot stamping die is higher than the evaporating temperature of the refrigerant.

6. The cooling apparatus of claim 3, further comprising a heat exchanger provided in the refrigerant discharge line to cool the refrigerant such that the refrigerant supplied to the reservoir becomes a liquid.

7. The cooling apparatus of claim 1, wherein the controller is configured to control the flow regulator to increase a flow rate of the refrigerant supplied to the hot stamping die when an overheated gas is discharged from the hot stamping die or a temperature of the refrigerant discharged from the hot stamping die is higher than an evaporating temperature of the refrigerant, and the refrigerant discharged from the hot stamping die is not compressed.

8. The cooling apparatus of claim 3, wherein the controller is configured to controls the flow regulator to supply the refrigerant to the cooling channel at a flow rate equal to or greater than a minimum flow rate set to correspond to a size of an object to be formed in the hot stamping die, a target temperature of the object after the forming, and a process time.

9. The cooling apparatus of claim 8, wherein the controller is configured to control the minimum flow rate based on the following equation:

$$\dot{m}_{min} = \frac{A \cdot D \cdot \rho \cdot C_p \cdot \Delta T}{(t_1 + t_2)} \cdot \frac{1}{h_{fg}},$$

wherein $\dot{m}_{min}$ is the minimum flow rate [kg/s], A is an area [$m^2$] of the object, D is a thickness [m] of the object, ρ is density of the object, Cp is specific heat [kJ/kg° C.] of the object, ΔT is a difference between an initial temperature and a final temperature of the object, $t_1$ is an amount of time required for forming the object, $t_2$ is an amount of time required for replacing the object, and $h_{fg}$ is latent enthalpy [kJ/kg] of the refrigerant.

* * * * *